United States Patent [19]

Aagaard

[11] Patent Number: 4,726,445

[45] Date of Patent: Feb. 23, 1988

[54] MOBILE LIFT

[75] Inventor: Niels Aagaard, Holbaek, Denmark

[73] Assignee: Hansen & Skov A/S, Holbaek, Denmark

[21] Appl. No.: 931,658

[22] Filed: Nov. 17, 1986

[30] Foreign Application Priority Data

Nov. 20, 1985 [DK] Denmark ..... 5367/85

[51] Int. Cl.[4] ..... B66F 11/04

[52] U.S. Cl. ..... 182/2; 182/17

[58] Field of Search ..... 182/2, 63, 17, 65, 66, 182/67; 212/189, 266

[56] References Cited

U.S. PATENT DOCUMENTS

| | | | |
|---|---|---|---|
| 2,893,502 | 7/1959 | Scheuerplug | 212/189 |
| 3,056,465 | 10/1962 | Gerrans | 182/2 |
| 4,643,273 | 2/1987 | Stokoe | 182/2 |

FOREIGN PATENT DOCUMENTS 0141552 10/1984 European Pat. Off. .

*Primary Examiner*—Reinaldo P. Machado

*Attorney, Agent, or Firm*—Merchant, Gould, Smith, Edell, Welter & Schmidt

[57] ABSTRACT

A mobile lift comprises an undercarriage structure having a tow bar (1), a towing extension (9) and road wheels (7) supporting a main swivel bearing (6) for a lift boom (5) with a basket or platform (4). The lift has a first supporting beam (1) formed integrally with the tow bar, a second supporting beam (2) extending therefrom on the other side of the main swivel bearing (6) and two further supporting beams (3). All supporting beams are arranged in such a manner that the longitudinal axes thereof in supporting position meet in the main bearing (6).

There is thus obtained a personnel lift where the undercarriage structure is very simple and consequently very cheap without reducing the strength, the reach or the carrying capacity of the lift.

3 Claims, 2 Drawing Figures

MOBILE LIFT

Figure 1:
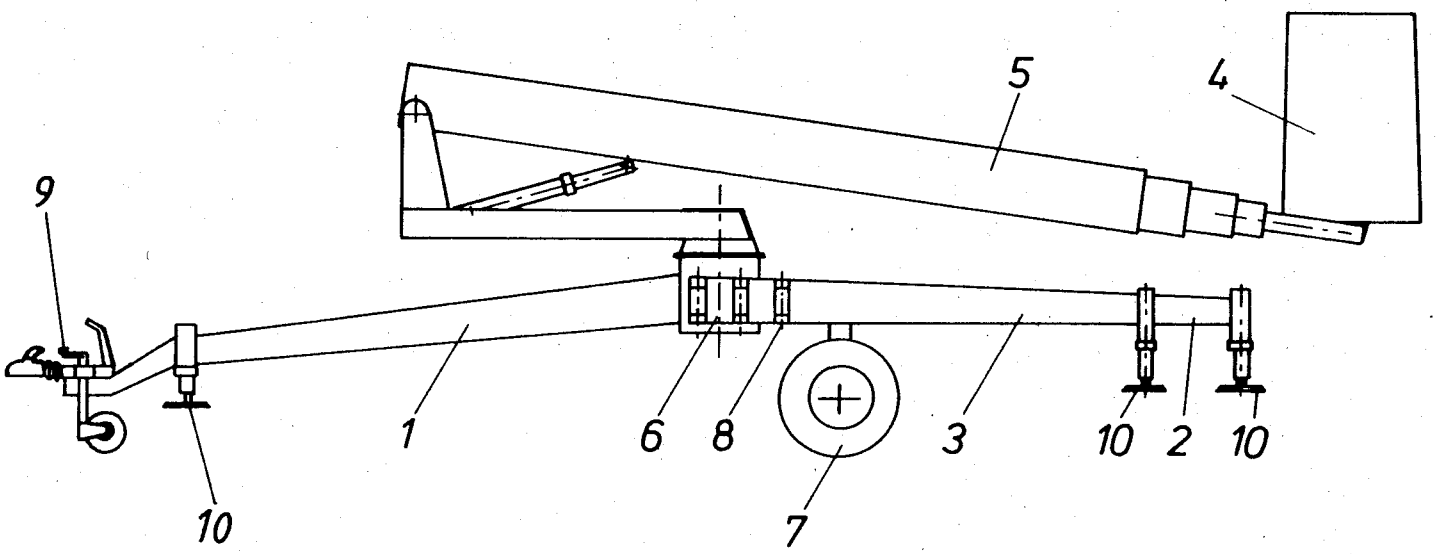

The invention relates to a mobile lift preferably towed by a vehicle and having a bucket or other extension for reaching high objects.

Personnel lifts have been known and used for many years. In recent years development has been in the direction of light-weight structures mounted on independent trailers. The undercarriage structure of such a trailer serves to carry the lift during transport in that as a trailer it can be towed by ordinary motor cars and to support the lift when same is used as a working machine in that the undercarriage is provided with supporting means in various manners. Such undercarriages are designed as a supporting frame structure forming the basis of the main swivel bearing of the lift and of the road wheels and the supporting means supporting the lift when in operation. Furthermore, there is usually provided a towing extension for use when connecting the lift and the towing vehicle. The known structures generally use at least four supporting devices which in some way or other can be extended from the supporting frame structure. When the supporting means are arranged in contact with the base, for example by means of jacks secured to the supporting means, there is defined a supporting surface forming in most lifts a square or a rectangle in such a manner that the diagonals intersect the longitudinal axis of the lift at about 45°. There is thus obtained a symmetrical structure and the intersection of the diagonals will coincide with the main swivel bearing. To obtain a large supporting surface it is necessary to use at least four supporting devices complete with mechanisms for swinging out, telescopic settlement or similer mechanisms secured to the supporting frame structure.

It is the object of the invention to provide a new lift structure where the undercarriage structure is very simple without impairing the strength or reducing the reach or carrying capacity of the lift.

This is achieved by designing the lift according to the invention as disclosed herein. Lifts already have a comparatively big transport length and this length is used for simplifying the structure. The main idea of the invention is that the supporting surface is turned 45° compared to the known structures whereby one diagonal coincides with the longitudinal axis of the lift. The towing bar is joined with one of the supporting beams and a further supporting beam is made to extend below the lift boom. The two remaining supporting beams can then be arranged transversely to the longitudinal axis like ordinary supporting beams arranged for being settled, swung out or telescopically manoeuvred. There is thus obtained a supporting surface which is just as large as by the known lifts but the structure becomes much more simple because two of the supporting beams are fixed.

By designing the lift according to the invention, the lift may be adapted to any application.

If the lift according to an alternate embodiment, there is obtained a substantially simplified structure in that the continuous beam will constitute the undercarriage so that the usual solid undercarriage frame can be spared.

By designing the lift according to the invention as disclosed in a further embodiment, it is possible to design the supporting surface completely symmetrical so that the carrying capacity and the reach of the lift are the same in all directions.

Figure 2:
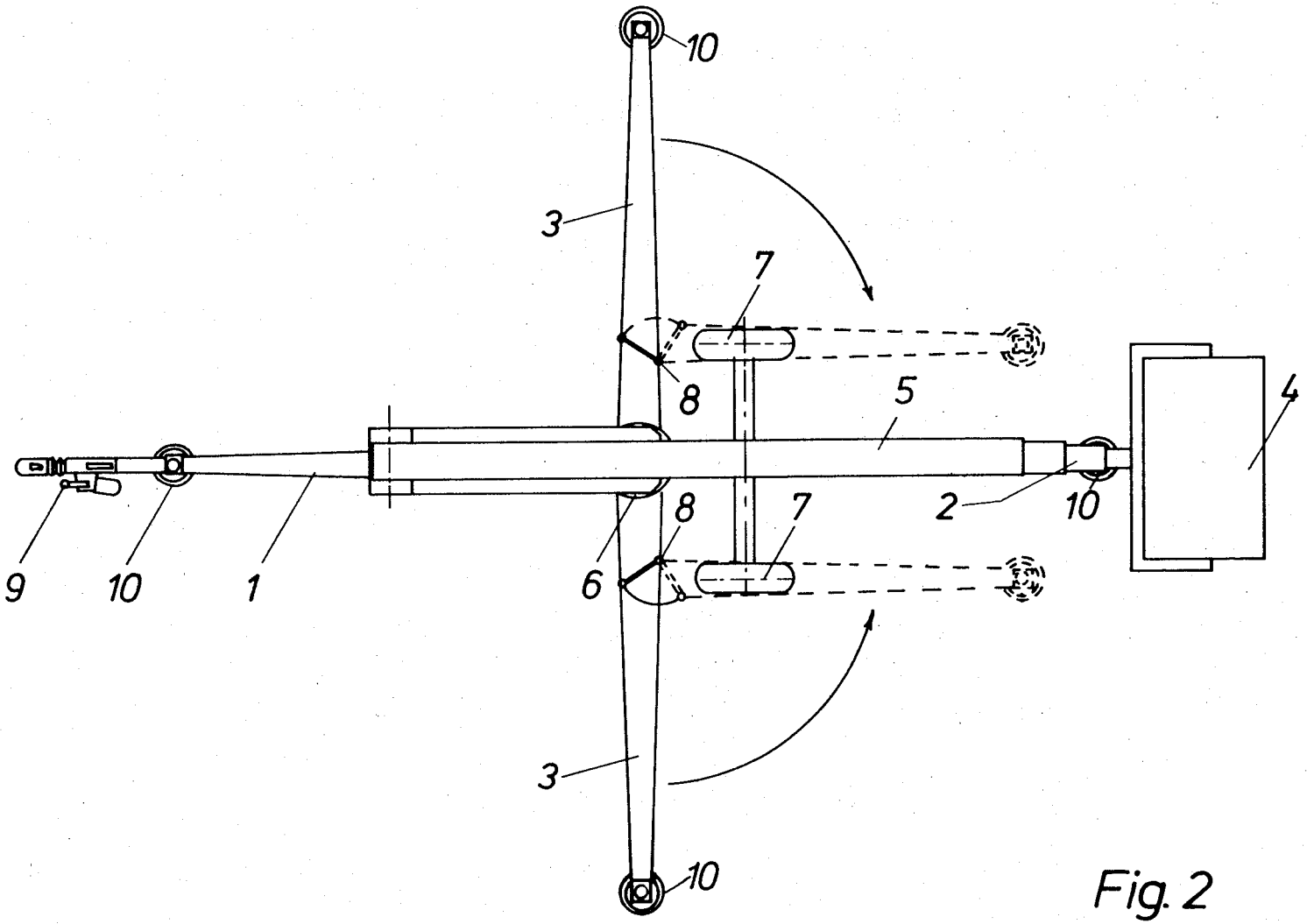

The invention will now be further explained with reference to the drawing wherein FIG. 1 is a side view of the lift according to the invention, and FIG. 2 is a top view of the lift.

The lift according to the invention comprises a common lift boom 5, for example a hydraulically operated telescopic lift supporting a basket or platform 4. The telescopic boom is manouvrably secured to a main swivel bearing 6 in that said main swivel bearing is secured to a beam structure formed by a tow bar 1 and a fixed supporting beam 2. The tow bar which at one end thereof is provided with a common towing extension 9 constitutes a supporting beam of the lift. To the main swivel bearing 6 there is moreover secured two supporting beams 3 intended for being swung out, e.g. by means of hinges 8. The supporting beams 3 can be swung towards the position of transport shown in dashed lines. In this position of transport the width of the lift is not greater than the width of the road wheels 7. The road wheels 7 are arranged on a shaft being secured to the rearwardly extending supporting beam 2. At the end of each supporting beam there is arranged a jack 10 which may be a mechanical or a hydraulic jack.

The structure shown in the drawing is merely an example of the invention. It is obvious to a person skilled in the art that the invention may be practised while using any known type of supporting beams whether hydraulic or mechanic or being arranged for telescopic settlement or for swinging out. Such supporting beams may be provided with jacks.

What is claimed is:

1. A mobile lift comprising in combination: an undercarriage structure having a tow bar for connection to a vehicle, a main support beam extending coaxially therefrom, an axle having a pair of road wheels at its ends attached to said main support beam, said wheels straddling said main support beam, a main swivel bearing along said main support beam, a lift boom movably attached to said main bearing, first and second side support beams extending each from said main support beam at one end and each having an adjustable support jack at the other end thereof, said beams being hinged at a point distant from said main support beam so that when said first and second beams are articulated 90° on their hinges, they will be generally coplanar with said road wheels.

2. A lift according to claim 1 wherein said main support beam includes a support jack approximate each end thereof, so that when said first and second beams are extended transversely to said main support beam, a four-point support is provided.

3. A mobile lift according to claim 1 wherein said hinges are located at a distance from said main support beam equal to the distance from said main support beam to the inner surface of each of said road wheels.

* * * * *